US007242894B2

(12) United States Patent
Kuo et al.

(10) Patent No.: US 7,242,894 B2
(45) Date of Patent: Jul. 10, 2007

(54) XEROGRAPHIC TRANSFER STATION USING A BELT

(75) Inventors: Youti Kuo, Penfield, NY (US); Robert A. Gross, Penfield, NY (US); David K. Ahl, Rochester, NY (US); Douglas A. McKeown, Geneseo, NY (US); Mark Stevens, Henrietta, NY (US); Gerald M. Fletcher, Pittsford, NY (US); Christopher A. DiRubio, Webster, NY (US)

(73) Assignee: Xerox Corporation, Stamford, CT (US)

( * ) Notice: Subject to any disclaimer, the term of this patent is extended or adjusted under 35 U.S.C. 154(b) by 82 days.

(21) Appl. No.: 10/989,085

(22) Filed: Nov. 15, 2004

(65) Prior Publication Data

US 2006/0104678 A1 May 18, 2006

(51) Int. Cl.
*G03G 15/20* (2006.01)

(52) U.S. Cl. ..... 399/313

(58) Field of Classification Search ..... 399/313, 399/314, 315

See application file for complete search history.

(56) References Cited

U.S. PATENT DOCUMENTS 4,274,361 A * 6/1981 Sanders et al. ..... 399/313
4,407,580 A 10/1983 Hashimoto et al. ..... 355/3 TR
5,227,854 A * 7/1993 Dastin et al. ..... 399/303
5,600,405 A * 2/1997 Umeda et al. ..... 399/71
5,623,330 A 4/1997 Ishibashi ..... 399/310
5,812,919 A * 9/1998 Takano et al. ..... 399/313 X
5,893,022 A 4/1999 Yoshino et al.
5,930,573 A 7/1999 Miyamoto et al. ..... 399/310
6,067,435 A 5/2000 Soga et al.
6,603,945 B2 * 8/2003 Amarakoon et al. ..... 399/309
2003/0113141 A1 6/2003 Saito et al.

OTHER PUBLICATIONS

Christopher A. DiRubio et al., U.S. Appl. No. 10/989,086, filed simultaneously herewith, entitled "Control System for a Xerographic Transfer Station Using a Belt".

* cited by examiner

*Primary Examiner*—David M. Gray
*Assistant Examiner*—Erika J. Villaluna
(74) *Attorney, Agent, or Firm*—R. Hutter

(57) ABSTRACT

An electrostatographic printing apparatus comprises a charge receptor, and a transfer station for transferring a toner image from the charge receptor to a sheet. The sheet passes through a nip formed between the charge receptor and a moving transfer belt. Upstream of the nip, the belt forms a shallow angle relative to the charge receptor; downstream of the nip, the belt forms a steep angle relative to the charge receptor. This configuration enables self-stripping of the sheet from the transfer belt at the exit of the nip.

17 Claims, 3 Drawing Sheets

XEROGRAPHIC TRANSFER STATION USING A BELT

CROSS-REFERENCE TO RELATED APPLICATION

Cross-reference is hereby made to U.S. patent application Ser. No. 10/989,086, now U.S. Published Application 20060104651-A1, filed simultaneously herewith.

TECHNICAL FIELD

The present disclosure relates to a transfer station used in electrostatographic or xerographic printing.

BACKGROUND

The basic process steps of electrostatographic printing, such as xerography or ionography, are well, known. Typically an electrostatic latent image is created on a charge receptor, which in a typical analog copier or "laser printer" is known as a photoreceptor. The suitably charged areas on the surface of the photoreceptor are developed with fine toner particles, creating an image with the toner particles which is transferred to a print sheet, which is typically a sheet of paper but which could conceivably be any kind of substrate, including an intermediate transfer belt. This transfer is typically carried out by the creation of a "transfer zone" of electric fields where the print sheet is in contact with, or otherwise proximate to, the photoreceptor. Devices to create this transfer zone, such as corotrons, are well known.

Another condition that is known to be useful in a transfer zone is mechanical pressure between the print sheet and the photoreceptor: a certain amount of pressure can enhance transfer efficiency, image quality and "latitude" (the range of types of paper or other substrate which can be effectively printed on). To obtain such pressure, it is known to use a "bias transfer roll," which is an electrically-biased roll urged against either a rigid photoreceptor drum or a backing member inside a photoreceptor belt. The combination of mechanical pressure and electrical bias creates a suitable transfer zone in the nip between the bias transfer roll and the photoreceptor.

The present disclosure relates to a novel apparatus for creating suitable conditions in a transfer zone.

PRIOR ART

U.S. Pat. Nos. 4,407,580; 5,623,330; and 5,930,573 disclose designs of transfer stations using a transfer belt.

SUMMARY

According to one aspect, there is provided an electrostatographic printing apparatus, comprising a charge receptor, a transfer roll, and a transfer belt entrained around the transfer roll and forming a nip with the charge receptor for passage of an image-receiving substrate in a process direction therethrough. The transfer belt is movable in a rotation direction. An exit portion of the transfer belt forms an angle of more than 30° relative to an adjacent portion of the charge receptor.

According to another aspect, there is provided an electrostatographic printing apparatus, comprising a charge receptor, a transfer roll, and a transfer belt entrained around the transfer roll and forming a nip with the charge receptor for passage of an image-receiving substrate in a process direction therethrough. A charge source removes material from the transfer belt, the charge source being disposed substantially immediately downstream of the nip along a direction of motion of the transfer belt. A cleaning assembly is associated with the transfer belt.

DETAILED DESCRIPTION

Figure 1:
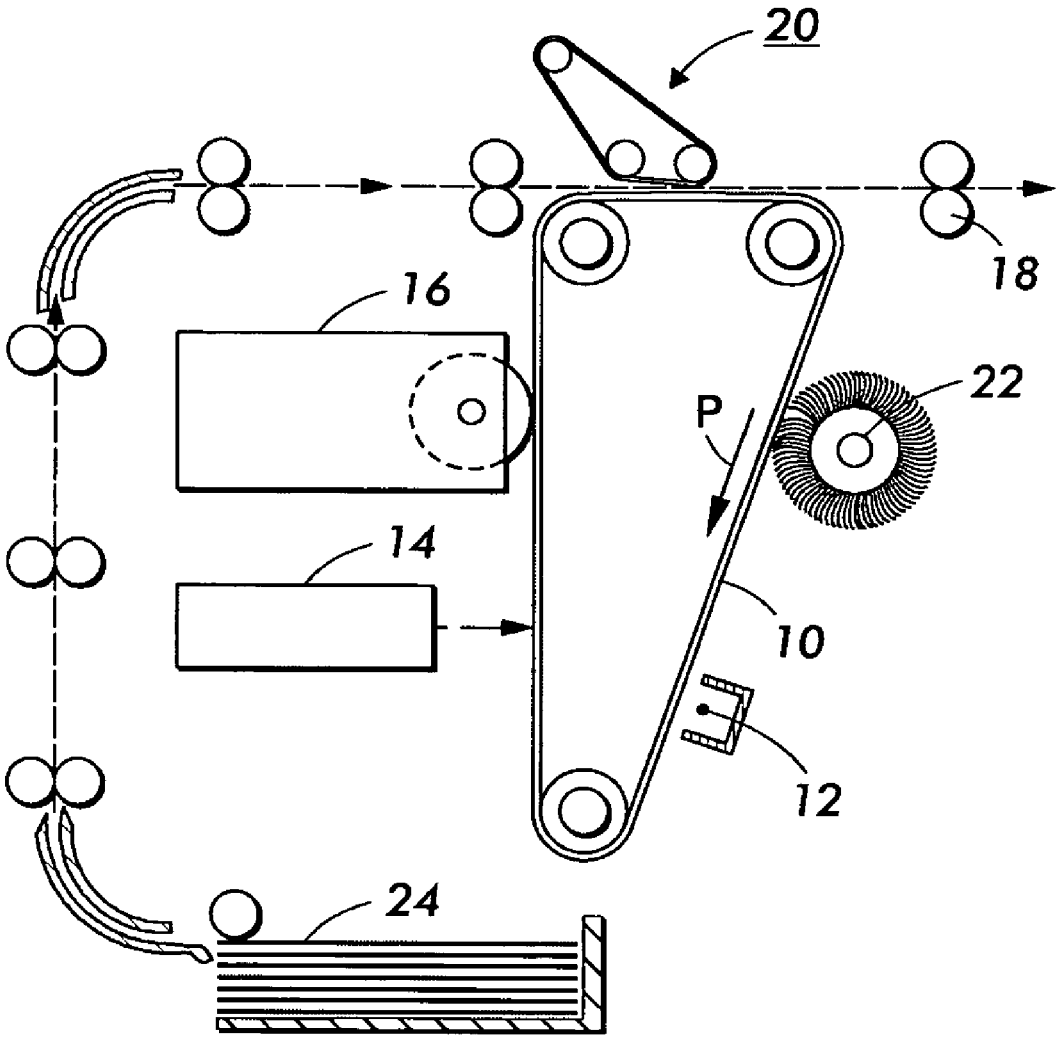
FIG. 1 is a simplified elevational diagram showing some essential elements of an electrostatographic printing apparatus, such as a printer or copier.

FIG. 1 is a simplified elevational diagram showing some essential elements of an electrostatographic printing apparatus, such as a printer or copier. As is familiar in electrostatographic printing, in particular ionography or xerography, electrostatic latent images are created on the surface of a charge receptor, such as the photoreceptor indicated as 10. As is generally familiar in xerography, there is further included a charge corotron 12 for initially uniformly charging the surface of photoreceptor 10; an exposure device 14, such as including a laser or an LED printbar, for discharging portions of the surface of photoreceptor 10 to yield a desired electrostatic latent image; a development unit 16, for causing toner particles to attach to suitably charged image areas on the surface of photoreceptor 10; and a transfer station 20, as will be discussed below. Downstream of transfer station 20 is a fusing apparatus 18 for fixing toner particles onto a print sheet to yield a permanent image. Any toner particles remaining on the photoreceptor after transfer are removed by cleaning station 22.

The sheets (or, more broadly, substrates) on which images are desired to be printed are drawn from a stack 24 and brought into a "transfer zone" which, depending on a particular design of the apparatus, typically involves contact or proximity of the sheet with the surface of the photoreceptor 10, as well as suitable electric fields. The transfer station 20 includes apparatus for creating suitable conditions for the transfer zone.

Figure 2:
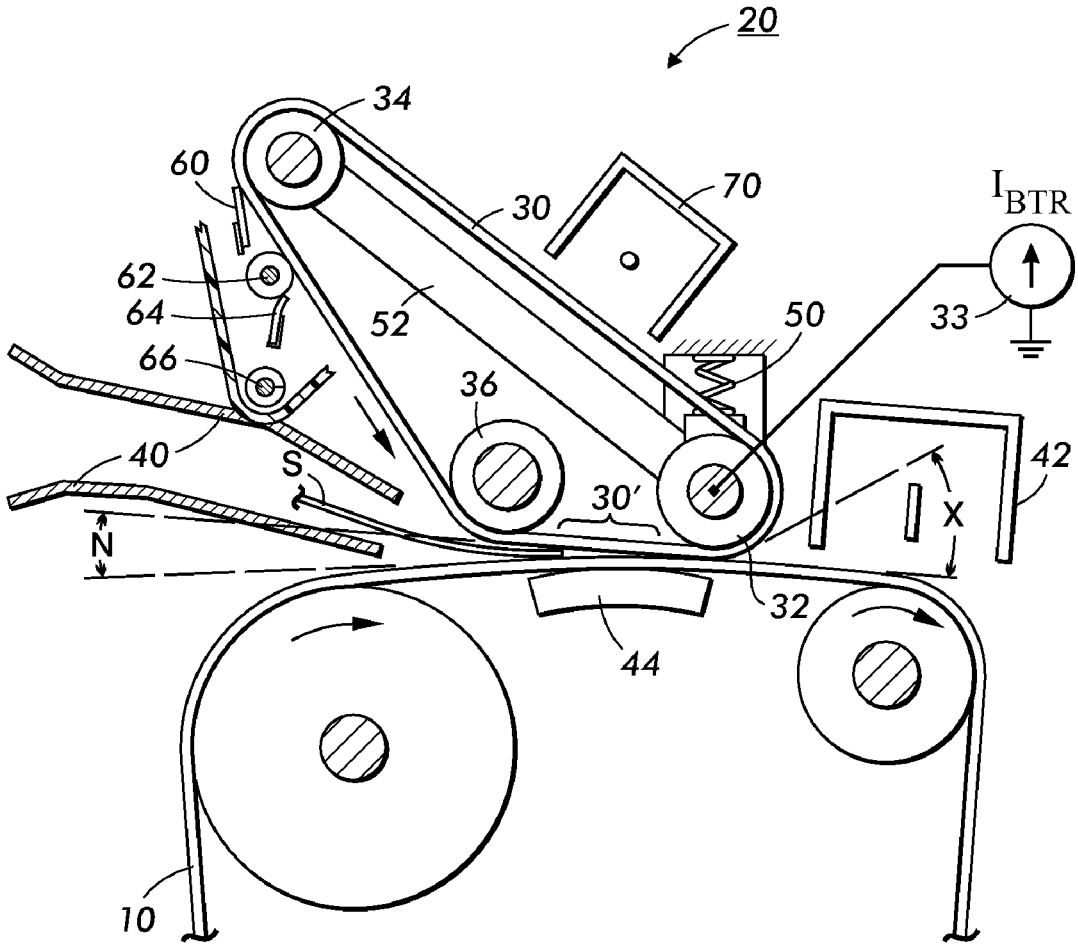
FIG. 2 is a detailed elevational view of one embodiment of a transfer station.

FIG. 2 is an elevational view showing one embodiment of transfer station 20 in detail. There is provided a transfer belt 30, which is rotatably entrained around, in this embodiment, a "transfer roll" 32, as well as a first carrier roll 34 and a second carrier roll 36. Transfer belt 30 is generally made of a substantially soft, flexible material, such as including rubber; it is also possible to provide a relatively stiff belt, comprising plastic. The transfer roll 32 is disposed to place a portion of the transfer belt 30 in contact with a portion of photoreceptor 10, thus forming a nip between photoreceptor 10 and the portion of transfer belt 30. Transfer roll 32 typically comprises a bare metal shaft, or a metal shaft surrounded by a controlled-conductivity elastomer. In operation, as photoreceptor 10 is caused to move in a process direction as shown, the transfer belt 30 is caused to move in a rotation direction with the photoreceptor 10, with minimal slippage at the nip; this can be accomplished, in various designs, by having the transfer belt 30 ride passively with the motion of photoreceptor 10, or by having the transfer belt 30 to some extent be moved by an independent motor (not shown).

As shown in the Figure, an image-receiving substrate, such as a print sheet or substrate S, passes in a process direction through a baffle 40 and approaches the nip between photoreceptor 10 and transfer belt 30. At the nip itself, a toner image on the photoreceptor 10 is transferred to a print sheet passing between photoreceptor 10 and transfer belt 30 by a combination of physical pressure at the nip (caused at least in part by transfer roll 32) and an electrical bias placed on transfer roll 32 (such as by a contact and circuitry generally indicated as 33), which causes a suitable electric field to be established across the nip. This electric field can have AC and DC aspects.

As further shown in the Figure, the portion of transfer belt 30 corresponding to a position at the entrance of the nip (an "entry portion"), indicated as 30', forms a shallow angle with the adjacent portion of photoreceptor 10. This angle, indicated as N in the Figures should be less than 30° and as shown can be less than 10°. With respect to the exit side of the nip (the "exit portion," on the right-hand side of transfer roll 32 in the Figure), the curvature and wrap angle of transfer belt 30 around transfer roll 32 should be such that the substrate S exiting the nip should be self-stripping from the transfer belt 30. In practice, to ensure that the substrate does not adhere to the transfer belt 30, the angle, indicated in the Figures as X, formed between adjacent portions of transfer belt 30 and photoreceptor 10 is greater than 30°; as shown in the illustrated embodiment, the angle is greater than 90°. In other words, the total wrap angle of the transfer belt 30 around the circumference of transfer roll 32 is, in this embodiment, greater than 90°. In a practical embodiment, the diameter of transfer roll 32 is not more than 25 mm.

This configuration of the transfer roll 30 creates a transfer zone, the result of pressure and electric-field conditions, which is focused at the nip between transfer belt 30 and photoreceptor 10 made by the pressure of transfer roll 32. The "steep" angle of the transfer belt 30 immediately downstream of the nip is helpful in detacking the sheet or substrate S from the transfer belt 30 as the sheet exits the nip. To detack the sheet from the photoreceptor 10, there can further be provided a detack device, such as corotron 42, the general operation of which is known in the art: corotron 42 applies an electric charge to the sheet S, opposite to the charge previously deposited onto the sheet in the transfer zone. This reduces the net charge, and therefore reduces the electrostatic attraction between the sheet S and the portion of the photoreceptor 10 downstream of the nip.

Further as shown in FIG. 2, there is provided a spring 50, here in the form of a coil spring, and a mounting arm 52, which causes the transfer roll 32 to be urged against the photoreceptor 10 at the nip. If the photoreceptor 10 is in the form of a flexible belt, as in the Figure, then there can be provided a suitable backing member, such as skid 44, against which the transfer roll 32 can be urged.

In a practical application, to avoid marks caused by stray toner particles on the transfer belt 30 contacting the photoreceptor 10 or the back of a sheet, there is provided what can be generally called a "cleaning assembly" for the transfer belt 30. In the FIG. 2 embodiment, there is provided a cleaning blade 60 for mechanical removal of toner particles, as well as a electrically-biased cleaning roll 62 for electrostatic cleaning of the belt 30. The cleaning roll 62 (which is biased by external circuitry, not shown) is in turn mechanically cleaned by a cleaning blade 64, which may itself be electrically biased. Collected toner particles removed by either cleaning blade 60 or cleaning roll 62 are collected in a small hopper, where they may be conveyed out by an auger 66.

Figure 3:
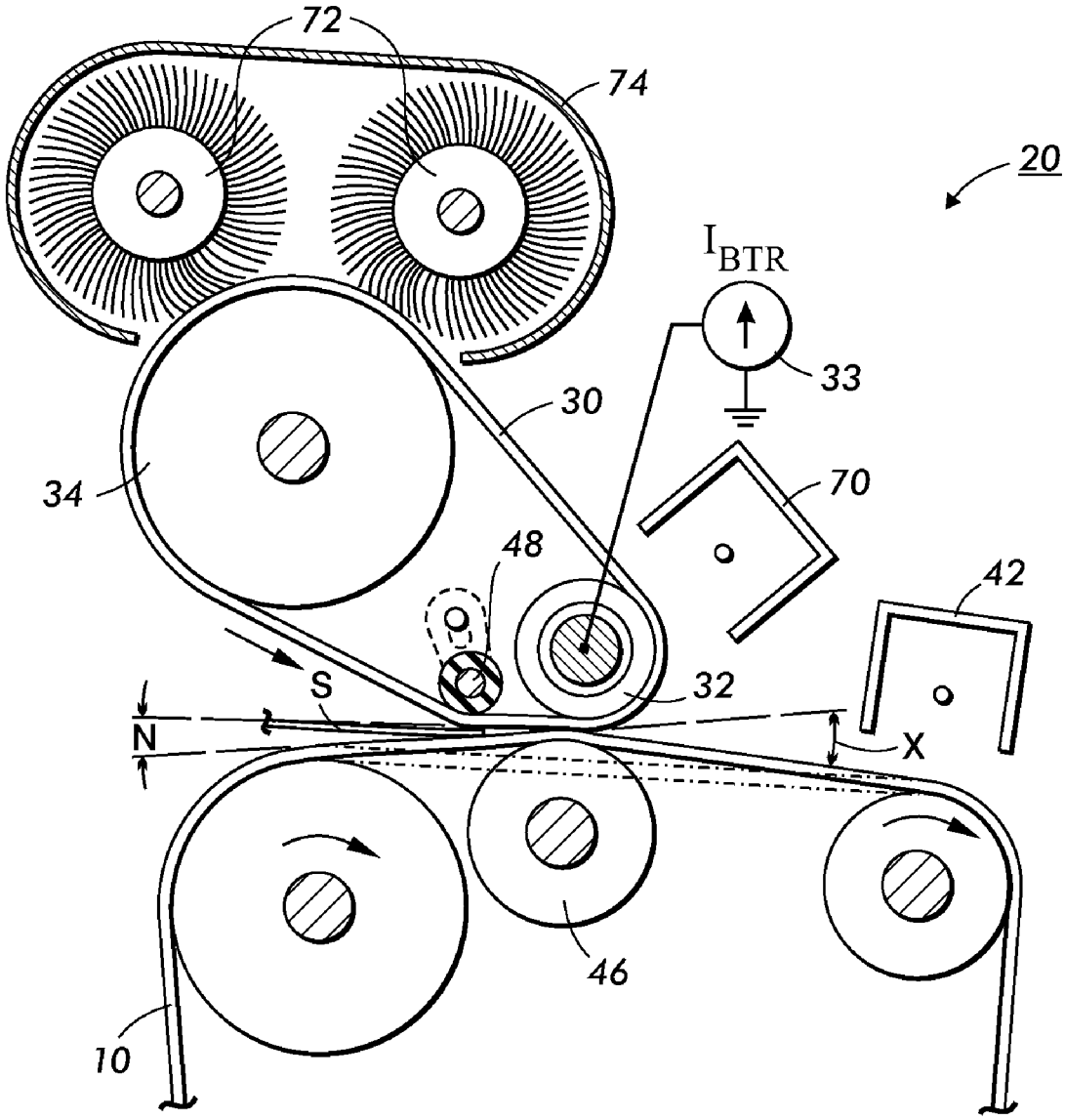
FIG. 3 is a detailed elevational view of another embodiment of a transfer station.

FIG. 3 is a detailed elevational view of another embodiment of a transfer station. In FIGS. 2 and 3, like reference numbers relate to like elements. As shown in FIG. 3, the transfer roll 32 is disposed through photoreceptor 10 against a backing roll 46. There is further provided a springably-mounted tension roller 48 (or more broadly a "tensioner," which may not include a roller), which maintains a desired tension on transfer belt 30. For purposes of cleaning the transfer belt 30, there is provided a cleaning corotron 70 (more broadly, a "charge source") that is directed at a portion of the transfer belt 30 downstream of the nip, as shown. The cleaning corotron 70 contributes to dislodging of toner particles that are adhering to the transfer belt 30. Further downstream of cleaning corotron 70 is another type of cleaning assembly, including two rotating brushes 72 in moving contact with a portion of the transfer belt 30, and which are in turn surrounded by a vacuum manifold 74, connected to a vacuum source (not shown), which removes toner or dirt particles from the brushes 72.

In either illustrated embodiment, the transfer roll 32 is the only location along the transfer belt 30 in which an electrical field is provided having a direct effect at the nip. Although the transfer roll 32 is shown as a rotatable roller, it is possible that the transfer roll 32 could be a rigid, non-rolling member around which the transfer belt slides: such a design may be useful in concentrating pressure in the nip in a small surface area.

In either illustrated embodiment, the print sheet passing through the nip does not travel on, nor is significantly moved by, the transfer belt 30. The wrap angle of the transfer belt around either side of transfer roll 32 should be such to avoid tacking of the print sheet to the transfer belt. In one possible arrangement of fields in and around the transfer zone, as the sheet moves toward the detack corotron 42, the sheet is electrostatically tacked to the photoreceptor 10, and the back side thereof is stripped from the transfer belt 30. For this reason, the photoreceptor 10 mainly contributes to the motion of the sheet through the nip, and only a small part of the motion is contributed by the transfer belt 30. This arrangement is in clear contrast to some prior-art systems, in which the sheet is tacked onto the transfer belt, and is thus conveyed past the photoreceptor by the motion of the transfer belt.

Although the illustrated embodiments disclose a monochrome xerographic printer where a toner image is transferred from a photoreceptor 10 directly to a print sheet, a "charge receptor" can also be an intermediate member or belt that accumulates a set of primary-color toner images from a set of photoreceptors in a color printing apparatus. Thus, transfer stations such as generally described and indicated as 20 in the Figures can be used to transfer toner images from such an intermediate member to a print sheet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants, patentees, and others.

The invention claimed is:

1. An electrostatographic printing apparatus, comprising:

a charge receptor, comprising a flexible belt;

a transfer belt in contact with the charge receptor at a transfer zone, the transfer belt being entrained around at least one transfer roll, the transfer roll being disposed near the transfer zone;

the transfer belt forming an angle of less than 30° relative to an adjacent portion of the charge receptor at an entry portion of the transfer zone and a wrap angle of at least 90° around the transfer roll at an exit portion of the transfer zone.

2. The apparatus of claim 1, where the charge receptor comprises a flexible belt and an entry portion of the transfer belt forms an angle of less than 10° relative to an adjacent portion of the charge receptor.

3. The apparatus of claim 1, further comprising means for electrically biasing the transfer roll.

4. The apparatus of claim 3, wherein the transfer roll is biased to contribute to a substrate passing through the nip being electrostatically tacked to the charge receptor downstream of the nip.

5. The apparatus of claim 3, wherein the transfer roll is a sole source of direct electrical bias relative to the nip.

6. The apparatus of claim 1, further comprising at least one carrier roll, the transfer belt being entrained around the carrier roll.

7. The apparatus of claim 1, further comprising a charge source, associated with the transfer bet, useful in removing material from the transfer belt.

8. The apparatus of claim 7, the charge source being disposed substantially immediately downstream of the nip along a direction of motion of the transfer belt.

9. The apparatus of claim 1, further comprising a cleaning blade, associated with the transfer belt.

10. The apparatus of claim 1, further comprising a cleaning brush, associated with the transfer belt.

11. The apparatus of claim 1, further comprising a vacuum manifold, associated with the transfer belt.

12. The apparatus of claim 1, further comprising a detack device, associated with the charge receptor, disposed downstream of the nip along the process direction.

13. The apparatus of claim 1, wherein the charge receptor is a photoreceptor.

14. An electrostatographic printing apparatus, comprising:

a charge receptor, comprising a flexible belt;

a transfer belt in contact with the charge receptor at a transfer zone, the transfer belt being entrained around at least one transfer roll, the transfer roll being disposed near the transfer zone;

the transfer belt forming an angle of less than 30° relative to an adjacent portion of the charge receptor at an entry portion of the transfer zone and a wrap angle of at least 90° around the transfer roll at an exit portion of the transfer zone;

a charge source, associated with the transfer belt, useful in removing material from the transfer belt, the charge source being disposed substantially immediately downstream of the exit portion of the transfer zone along a direction of motion of the transfer belt; and a cleaning assembly associated with the transfer belt.

15. The apparatus of claim 14, the cleaning assembly including at least one of a cleaning blade, a cleaning brush, and a vacuum manifold.

16. The apparatus of claim 14, further comprising means for electrically biasing the transfer roll, to contribute to a substrate passing through the nip being electrostatically tacked to the charge receptor downstream of the nip.

17. The apparatus of claim 14, further comprising a detack device, associated with the charge receptor, disposed downstream of the nip along the process direction.

* * * * *